US009742062B2

(12) United States Patent
Park et al.

(10) Patent No.: US 9,742,062 B2
(45) Date of Patent: Aug. 22, 2017

(54) SMALL SWITCHABLE DIRECTIONAL CONTROL ANTENNA

(71) Applicant: Electronics and Telecommunications Research Institute, Daejeon (KR)

(72) Inventors: Ju Derk Park, Daejeon (KR); Ho Yong Kang, Daejeon (KR); Cheol Sig Pyo, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 427 days.

(21) Appl. No.: 14/299,870

(22) Filed: Jun. 9, 2014

(65) Prior Publication Data

US 2015/0155625 A1 Jun. 4, 2015

(30) Foreign Application Priority Data

Nov. 29, 2013 (KR) ..... 10-2013-0147174

(51) Int. Cl.
*H01Q 3/24* (2006.01)
*H01Q 9/04* (2006.01)
*H01Q 1/48* (2006.01)

(52) U.S. Cl.
CPC ..... *H01Q 3/247* (2013.01); *H01Q 1/48* (2013.01); *H01Q 9/0407* (2013.01)

(58) Field of Classification Search
None
See application file for complete search history.

(56) References Cited

U.S. PATENT DOCUMENTS

2004/0227678 A1* 11/2004 Sievenpiper ..... H01Q 1/243 343/702
2010/0194663 A1* 8/2010 Rothwell ..... H01Q 9/0442 343/876
2013/0207842 A1 8/2013 Small

FOREIGN PATENT DOCUMENTS

KR 1020130082353 A 7/2013

* cited by examiner

*Primary Examiner* — Robert Karacsony
(74) *Attorney, Agent, or Firm* — William Park & Associates Ltd.

(57) ABSTRACT

Provided is a small switchable directional control antenna that can perform direction control according to shapes and sizes of various devices. The antenna includes a dielectric layer, a radiation patch formed on a side of the dielectric layer, a ground plane formed on a side of the dielectric layer opposite to the side on which the radiation patch is formed and configured to have a plurality of slots formed at edges thereof, and a control module insulated from the ground plane and configured to control electrical connection between the radiation patch and the ground plane.

9 Claims, 7 Drawing Sheets

SMALL SWITCHABLE DIRECTIONAL CONTROL ANTENNA

CROSS-REFERENCE TO RELATED APPLICATIONS

This application claims priority under 35 U.S.C. §119 to Korean Patent Application No. 10-2013-0147174, filed on Nov. 29, 2013, the disclosure of which is incorporated herein by reference in its entirety.

TECHNICAL FIELD

The present invention relates to a small switchable directional control antenna, and more particularly, to a small switchable directional control antenna that can perform direction control according to shapes and sizes of various devices.

BACKGROUND

Unlike existing networks, wireless sensor networks are basically configured to collect information automatically and remotely rather than to perform communication, and widely used in a variety of applications, such as scientific, medical, military, and commercial uses.

Each sensor network includes a plurality of sensor nodes configured to sense and transmit information using sensors and a sink node configured to transmit the information collected by the plurality of sensor nodes to the outside.

In this case, each sensor node has a simple configuration including a sensor configured to sense information, a processor configured to process the sensed information, and a radio transceiver configured to transmit the processed information. For the convenience of installation and use, each sensor node is required to have little power consumption and miniaturization so as to operate for the long time using limited battery power. To satisfy the requirement of low power consumption and miniaturization, the sensor node generally has a simplified function and structure, having limited calculation capabilities.

In order to configure an antenna detecting a propagation direction or indicating a directional radiation direction, a phased array antenna or a wireless communication system supporting multiple ports has generally been employed. However, the phased array antenna and the wireless communication system need high power consumption and high calculation capability and need to include a plurality of RF ports.

In comparison, the small wireless device having a low-power consumption and limited calculation capabilities like the sensor node mostly supports an RF output of a single port and needs to control only the direction of a limited number of sectors.

Thus, in the case of the small wireless device such as the sensor node, it does not use a plurality of radiators like the phased array antenna to control the propagation direction but to configure an antenna with a single radiator and a plurality of parasitic elements to adjust an electrical length of a parasitic element and uses the interference between elements.

FIG. 1 illustrates a small sector antenna generally used in a small wireless device.

Referring to FIG. 1, the small sector antenna 10 includes a single monopole antenna 11 and a plurality of parasitic elements 12 installed at regular intervals in a circular form around the monopole antenna 11. A reference numeral 13 in FIG. 1 denotes a disk-type metal ground on which the monopole antenna 11 and the plurality of parasitic elements 12 are fixed. In this case, the length of the monopole antenna 11, the length of the parasitic elements 12, the distance between the monopole antenna 11 and the parasitic element 12, and the thickness of the disk-type metal ground are designed to be $\lambda/4$ ($\lambda$: radio signal wavelength).

The radiation direction of the small sector antenna is controlled by changing an electrical equivalent length according to change in capacitance of the plurality of parasitic elements 12.

In the related art, a varactor diode is commonly used as means of controlling the capacitance of the plurality of parasitic elements 12, which, however, disadvantageously accompanies complicated calculation to appropriately adjust a nonlinear corresponding relationship between a bias voltage and the radiation direction.

In addition, in order to convert a digital bit string generated due to the complicated calculation into a bias voltage of the varactor diode, a digital-to-analog converter (DAC) must be provided to increase the power consumption.

FIG. 2 is a schematic block diagram showing a radiation direction control device for a small sector antenna according to a conventional technology.

Referring to FIG. 2, the radiation direction control device for a small sector antenna includes a plurality of capacitance blocks 31, a plurality of switching units 32, and a control unit 33. The plurality of capacitance blocks 31 and the plurality of switching units 32 are matched to a plurality of parasitic elements 12 in a one-to-one fashion, and connected in series between the parasitic elements 12 and a ground. The control unit 33 controls the switching operations of the plurality of switching units 32.

Each of the switching units 32 includes an n+2 number of selective contact points T1 to Tn+2, two more than the number (n) of the capacitors of each of the capacitance blocks 31, where the n number of contact points T1 to Tn are connected to the capacitors of the capacitance block 31, and the two remaining contact points Tn+1 and Tn+2 are directly connected with the corresponding parasitic elements 12 and set for a short mode and an open mode. A fixed contact point T0 of the switching unit 32 is connected to a ground. The switching unit 32 is configured to connect one of the plurality of capacitors to the corresponding parasitic element 12 or short-circuit or open the parasitic element 12 by selectively connecting one of the plurality of selective contact points T1 to Tn+2 to the fixed contact point T0 according to the control of the control unit 33.

After selecting one of the selective contact points T1 to Tn+2 according to a control signal of the control unit 33, the switching unit 32 preferably maintains the selection until a next control signal is applied, for which the switching unit 32 may be implemented as a digital switch.

Each of the plurality of capacitance blocks 31 includes a plurality of capacitors C1 to Cn, each having a different capacitance value, connected in parallel. The one ends of the plurality of capacitors C1 to Cn are commonly connected to the parasitic element 12 and the other ends of the plurality of capacitors C1 to Cn are connected with the plurality of selective contact points T1 to Tn provided in the switching unit 32.

When the small sector antenna including the single RF port and the plurality of parasitic elements and the radiation direction control device for the small sector antenna are arranged in the same plane, the area of the antenna is increased in proportion to the length of the operating wavelength. Accordingly, there is a limitation in that if frequency becomes lower, the wavelength becomes longer and thus the area of the antenna is increased.

In addition, generally, the low power wireless device has a common ground, which is needed for the stable operation of the antenna, arranged in a substrate on which an RF element, a modem, etc. are mounted. If the common ground is not distributed appropriately to the radiation, the antenna has a ground included therein. In this case, the needed size or area of the ground is proportional to the wavelength, which may operate as a limitation in reduction of the size of a switchable directional control antenna. The low-power wireless transmitters such as an IoT transmission device, a sensor node, etc. are miniaturized due to the development of integration technologies. However, actually, research is not conducted so much about the miniaturization of the directional control antenna.

SUMMARY

Accordingly, the present invention provides a small switchable directional control antenna that can control its direction according to shapes and sizes of various devices.

In one general aspect, a small switchable directional control antenna includes: a dielectric layer; a radiation patch formed on a side of the dielectric layer; a ground plane formed on a side of the dielectric layer opposite to the side on which the radiation patch is formed and configured to have a plurality of slots formed at edges thereof; and a control module insulated from the ground plane and configured to control electrical connection between the radiation patch and the ground plane.

The dielectric layer may include a short pin configured to connect the radiation patch and the ground plane.

The control module may include a lumped circuit element connected between the radiation patch and the ground plane and maintained in an opened or closed state according to an external signal; and a control unit connected with the lumped circuit element and configured to control the lumped circuit element to selectively close or open the radiation patch and the ground plane.

The small switchable directional control antenna may further include a power feeder formed vertically through the dielectric layer and configured to receive an external current.

The power feeder may include: a power feeding line configured to receive the external current; and a power feeding point located at an end of the power feeding line and in contact with the radiation patch.

The small switchable directional control antenna may further include a connection connected with the control unit and configured to receive a control signal from an outside.

The small switchable directional control antenna may further include a connector provided on a bottom of the ground plane and configured to connect to an external device.

Other features and aspects will be apparent from the following detailed description, the drawings, and the claims.

DETAILED DESCRIPTION OF EMBODIMENTS

Figure 1:
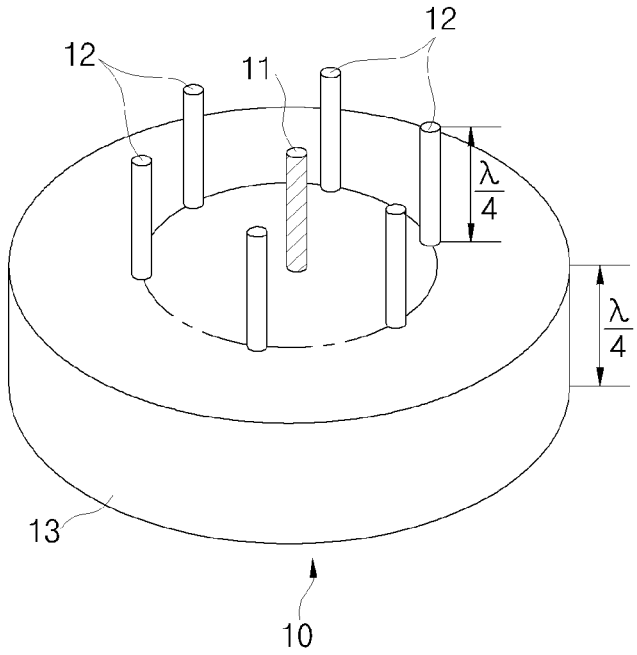
FIG. 1 illustrates a small sector antenna generally used in a small wireless device.
Figure 2:
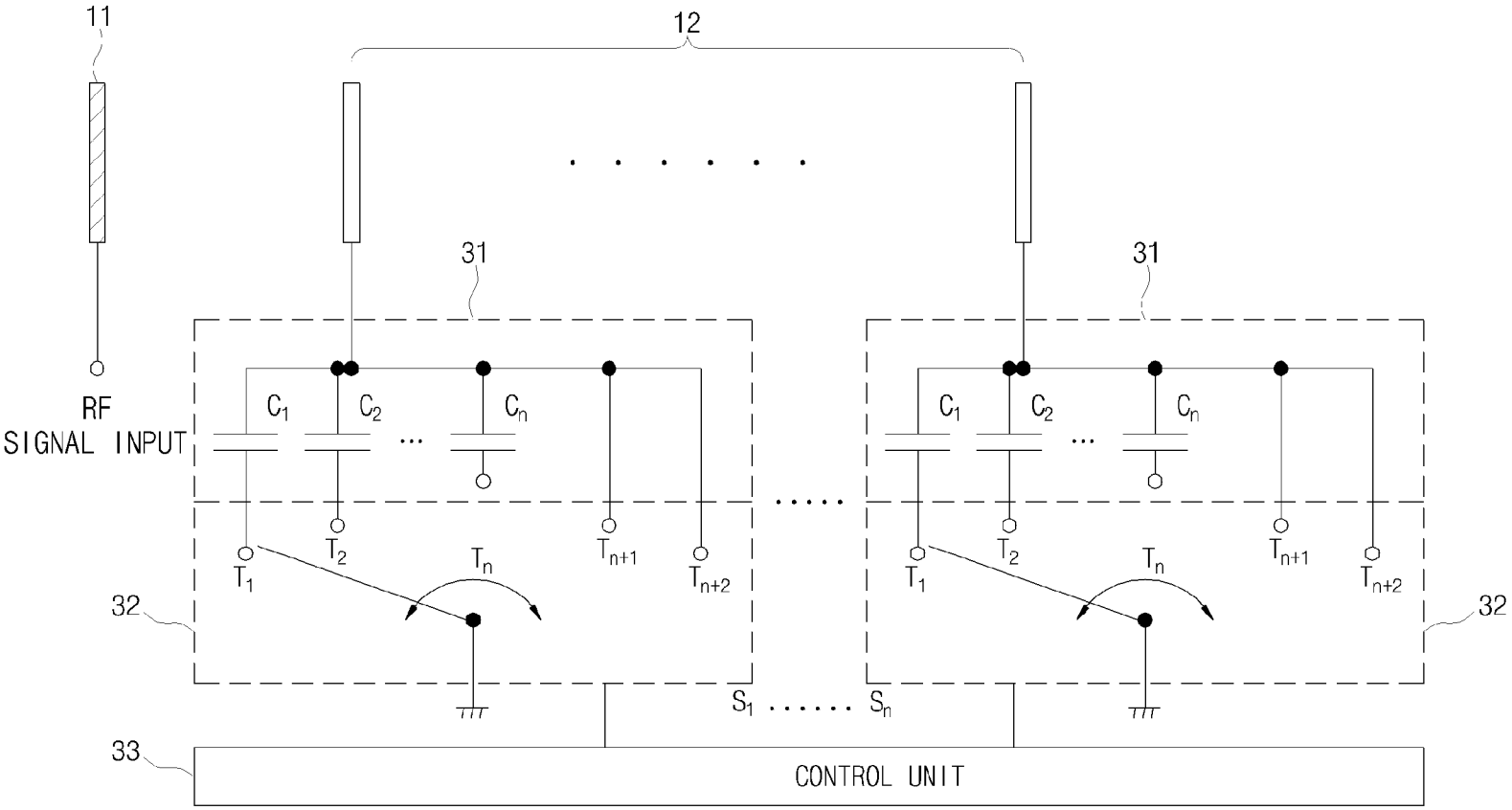
FIG. 2 is a schematic block diagram showing a radiation direction control device for a small sector antenna according to a conventional technology.

Hereinafter, preferred embodiments of the present invention will be described in detail with reference to the accompanying drawings such that a person skilled in the art may easily carry out the embodiments of the present invention. In the specification, the thickness of lines or the size of elements shown in the drawings may be enlarged for the clarity of a description and for the sake of convenience. The terms described below are defined in connection with the function of the present invention. The meaning of the terms may vary according to the user, the intention of the operator, usual practice, etc. Therefore, the terms should be defined based on the description rather than the specification.

Figure 3:
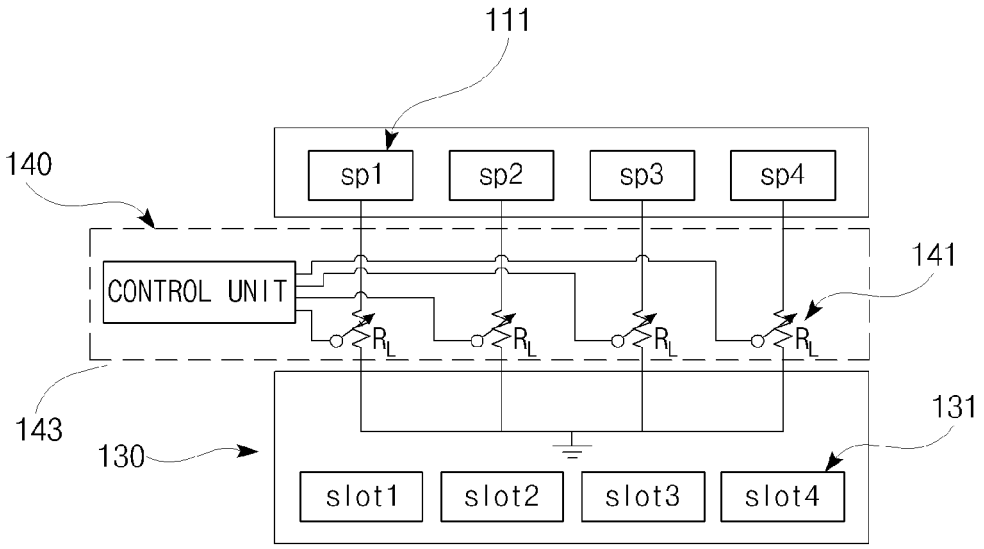
FIG. 3 is a block diagram showing a small switchable directional control antenna according to an embodiment of the present invention.
Figure 4:
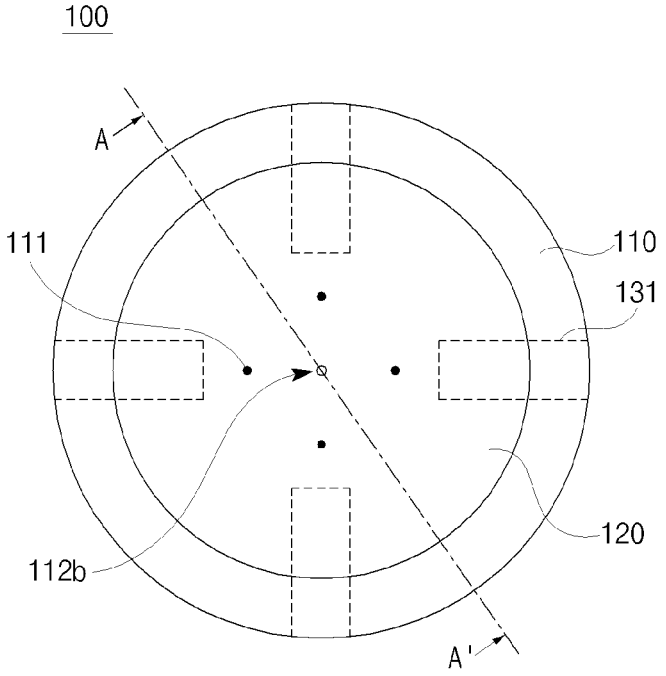
FIG. 4 is a top view showing a small switchable directional control antenna according to an embodiment of the present invention.
Figure 5:
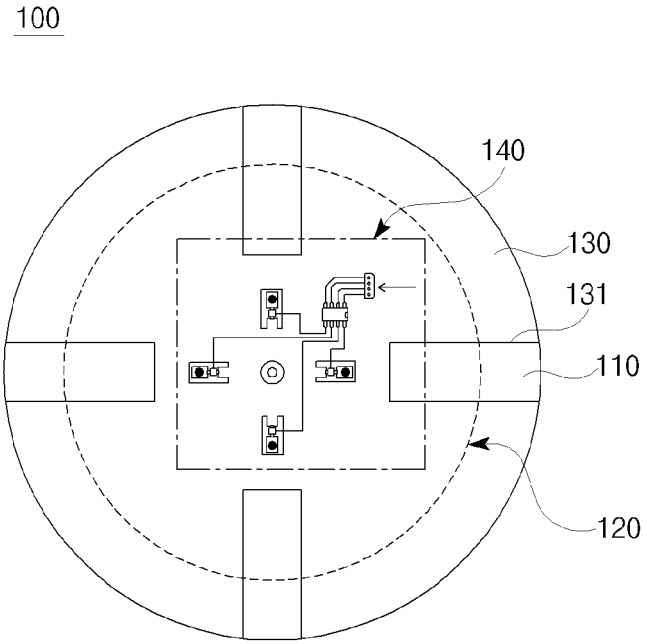
FIG. 5 is a bottom view showing the small switchable directional control antenna of FIG. 4.
Figure 6:
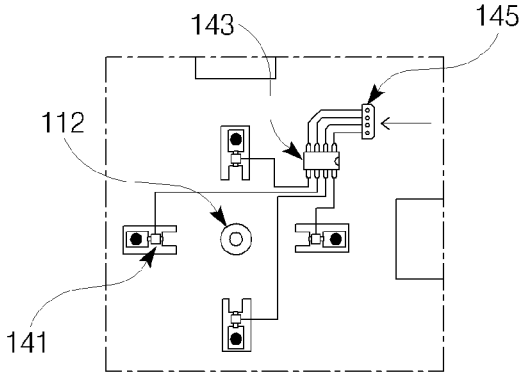
FIG. 6 is an enlarged view showing a control module of FIG. 4.
Figure 7:
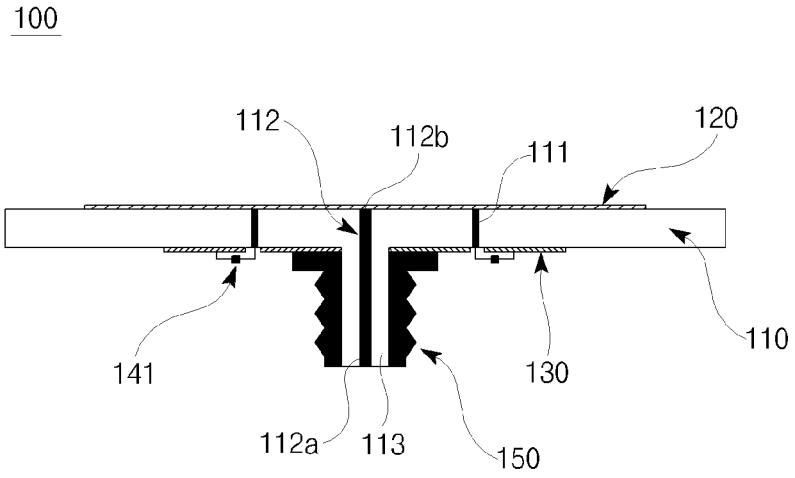
FIG. 7 is a cross sectional view showing the small switchable directional control antenna of FIG. 4 taken along a direction of A-A'.

FIG. 3 is a block diagram showing a small switchable directional control antenna according to an embodiment of the present invention; FIG. 4 is a top view showing a small switchable directional control antenna according to an embodiment of the present invention; FIG. 5 is a bottom view showing the small switchable directional control antenna of FIG. 4; FIG. 6 is an enlarged view showing a control module of FIG. 4; and FIG. 7 is a cross sectional view showing the small switchable directional control antenna of FIG. 4 taken along a direction of A-A'.

The configuration, operation, and effect of the small switchable directional control antenna according to an embodiment of the present invention will be described below in detail with reference to FIGS. 3 to 7.

A small switchable directional control antenna 100 according to an embodiment of the present invention may include a dielectric layer 110, a radiation patch 120 formed on a side (hereinafter, referred to as a "top side") of the dielectric layer 110, a ground plane formed on a side (hereinafter, referred to as a "bottom side") opposed to the top side of the dielectric layer 110, a control module 140 configured to control an electrical connection between the radiation patch 120 and the ground plane 130.

That is, the dielectric 110 is disposed between the radiation patch 120 and the ground plane 130, and the radiation patch 120 and the ground plane 130 are insulated by the dielectric layer 110 from each other.

The dielectric layer 110, the radiation patch 120, and the ground plane 130 may have various shapes and sizes according to an apparatus having the small switchable directional control antenna 100 of the present invention applied thereto, but in this embodiment, for example, are shown as having a disk form.

According to the present invention, the ground plane 130 may include e a slot 131, and the slot 131 may be formed at an edge of the ground plane 130. That is, the ground plane 130 according to an embodiment of the present invention has a slot 131 formed on the edge.

Accordingly, in the ground plane, a plurality of protrusions that are partitioned by the slot 131 are formed in a radial pattern, and a propagation direction is determined by the radial pattern.

In addition, according to an embodiment of the present invention, the dielectric layer 110 is provided with a short pin 111 for electrically connecting the radiation patch 120 and the ground plan 130, and the short pin 111 is formed through the dielectric layer 110.

In this case, the number of slots 131 and the number of short pins 111 are appropriately determined according to an apparatus having the small switchable directional control antenna of the present invention applied thereto. It would be desirable that the number of slots 131 should be equal to the number of short pins 111.

In this embodiment, the number of slots 131 and the number of short pins 111 are shown as being 4, respectively.

As such, when the number of slots 131 and the number of short pins 111 are more than one, respectively, it would be desirable that the slots 131 and the short pins 111 are formed spaced a certain distance apart.

The control module 140 of the present invention may be formed on the ground plane 130 and electrically insulated from the ground plane 130.

The control module 140 may include a lumped circuit element 141 connected between the short pin 111 and the ground plane 130 and a control unit 143 configured to control the lumped circuit element 141 to selectively close or open the short pin 111 and the ground plane 130.

Accordingly, the lumped circuit element 141 serves as a switch that is opened and closed by the control unit 143 to selectively close or open the short pin 111 and the ground plane 130.

The lumped circuit element 141 may be appropriately controlled according to an apparatus having the small switchable directional control antenna of the present invention applied thereto. It would be desirable that the number of slots 131 should be equal to the number of short pins 111.

As such, the lumped circuit element 141 is controlled by the control unit 143 to be in a closed state (ON) to connect the short pin 111 and the ground plane 130, resulting in electrical connection between the ground plane 130 and radiation patch 120 through the short pin 111.

On the contrary, the lumped circuit element 141 is controlled by the control unit 143 to be in an opened state (OFF) to disconnect the short pin 111 and the ground plane 130, resulting in electrical disconnection between the ground plane 130 and radiation patch 120.

The small switchable directional control antenna 100 of the present invention may further include a power feeder 112 formed vertically through the dielectric layer 110. The power feeder 112 may include a power feeding line 112*a* and a power feeding point 112*b* through which a current is applied from the outside. The power feeding point 112*b* is an end of the power feeding line 112*a*, which is in contact with the radiation patch 120.

The power feeder 112 receives the current from the outside and determines radiation characteristics, and desirably is provided in a central portion of the dielectric layer 110.

The small switchable directional control antenna 100 of the present invention includes the slot 131, the short pin 111, and the power feeding point 112*b* of the power feeder 112, which are formed on the ground plane 130. It would be desirable that the slot 131, the short pin 111, and the power feeding point 112*b* of the power feeder 112 are disposed in a straight line in terms of control of the radiation direction.

In addition, the control unit 143 of the present invention receives a control signal from an external device having the small switchable directional control antenna 100 and controls the lumped circuit element 141 according to the control signal. Accordingly, the small switchable directional control antenna 100 may further include a connection 145 connected with the control unit 143 and configured to receive the control signal from the external device.

In addition, the small switchable directional control antenna 100 is installed and used in a communication device such as a wireless device and thus needs a connector for connecting to the device.

Thus, the small switchable directional control antenna 100 of the present invention may further include a connector 150 for connecting to the external device.

The dielectric layer 110 may have an extension unit 113 vertically extended to be connected to the connector 150. It would be desirable that the extension unit 113 extends toward the ground plane 130.

Accordingly, the connector 150 is combined to the extension unit 113 and allowed to be provided on the bottom surface of the ground surface 130.

Since the slot 131 is formed on the ground plane 130 according to the present invention, the ground plane 130 includes protrusions partitioned by the slot 131 and formed in a radiation form.

In addition, according to the present invention, it is possible to connect the short pin 111 with the ground plane 130 according to control of the control module 140 to selectively ground a portion of the radiation patch 120.

Accordingly, when a current is applied to the power feeding point 112*b*, it is possible to ground a portion of the radiation patch according to control of the control module 140 to perform direction control.

In addition, since the ground plane 130 has protrusions partitioned by the slot 131 and formed in a radial pattern, coupling may be mainly performed at the slot 131, thereby enhancing radiation characteristics.

The small switching directional control antenna according to the present invention can perform direction control according to shapes and sizes of various devices such as a mobile communication terminal, a wireless LAN router, a communication node in a sensor network, a gateway of an IoT device, thereby miniaturizing the apparatus to enhance its mobility. The small switching directional control antenna can also be configured to \have a required number of sectors, thereby applying to a variety of wireless device.

As described above, the small switchable directional control antenna according to the present invention has been described according to preferred embodiments. However, the present invention is not limited to the particularly preferred embodiments. It is apparent to one skilled in the art that there are many various modifications and variations without departing off from the spirit or the technical scope of the appended claims.

Accordingly, the embodiments of the present invention are to be considered descriptive and not restrictive of the present invention, and do not limit the scope of the present invention. The scope of the present invention should be determined by the following claims and their appropriate legal equivalents.

What is claimed is:

1. A small switchable directional control antenna comprising:

a dielectric layer;

a radiation patch formed on a side of the dielectric layer;

a ground plane formed on a side of the dielectric layer opposite to the side on which the radiation patch is formed, and having a plurality of slots formed at edges thereof to form a plurality of protrusions between the slots; and a control module insulated from the ground plane and configured to selectively control electrical connection between the radiation patch and the protrusions of the ground plane, wherein the plurality of protrusions are formed in a radial pattern.

2. The small switchable directional control antenna of claim 1, wherein the dielectric layer comprises a short pin configured to connect the radiation patch and one of the protrusions of the ground plane.

3. The small switchable directional control antenna of claim 1, wherein the control module comprises:

a lumped circuit element connected between the radiation patch and the ground plane and maintained in an opened or closed state according to an external signal; and a control unit connected with the lumped circuit element and configured to control the lumped circuit element to selectively close or open the radiation patch and one of the protrusions of the ground plane.

4. The small switchable directional control antenna of claim 3, further comprising a power feeder formed vertically through the dielectric layer and configured to receive an external current.

5. The small switchable directional control antenna of claim 4, wherein the power feeder comprises:

a power feeding line configured to receive the external current; and a power feeding point located at an end of the power feeding line and in contact with the radiation patch.

6. The small switchable directional control antenna of claim 3, further comprising a connection connected with the control unit and configured to receive a control signal from an external device.

7. The small switchable directional control antenna of claim 1, further comprising a connector provided on a bottom surface of the ground plane and configured to connect to an external device.

8. The small switchable directional control antenna of claim 1, wherein the control module is configured to selectively control electrical connection between the radiation patch and the protrusions of the ground plane for direction control.

9. The small switchable directional control antenna of claim 1, further comprising:

a plurality of short pins in the dielectric layer; and wherein the control module is configured to selectively control electrical connection between the radiation patch and the protrusions of the ground plane via the plurality of short pins.

* * * * *